US006708651B1

(12) United States Patent
Sun

(10) Patent No.: US 6,708,651 B1
(45) Date of Patent: Mar. 23, 2004

(54) FEEDWATER APPARATUS

(75) Inventor: Nansheng Sun, Cambridge (CA)

(73) Assignee: Babcock & Wilcox Canada Ltd., New Orleans, LA (US)

( * ) Notice: Subject to any disclaimer, the term of this patent is extended or adjusted under 35 U.S.C. 154(b) by 0 days.

(21) Appl. No.: 10/429,360

(22) Filed: May 5, 2003

(51) Int. Cl.[7] ..... F22D 1/00

(52) U.S. Cl. ..... 122/414; 122/398; 122/403; 122/415

(58) Field of Search ..... 122/451 R, 451 S, 122/504, 438, 414, 398, 403, 415

(56) References Cited

U.S. PATENT DOCUMENTS

| | | | |
|---|---|---|---|
| 2,203,357 A | | 6/1940 | Kerr |
| 3,635,287 A | | 1/1972 | Sprague |
| 3,918,409 A | | 11/1975 | Schroeder |
| 4,057,033 A | | 11/1977 | Schlichting et al. |
| 4,168,071 A | | 9/1979 | Jacobson et al. |
| 4,212,594 A | | 7/1980 | Sheer, Jr. |
| 4,304,198 A | * | 12/1981 | Stiefel ..... 122/504 |
| 4,834,935 A | | 5/1989 | Daigle et al. |
| 4,844,274 A | | 7/1989 | Sterk |
| 5,345,484 A | | 9/1994 | Deaver et al. |
| 5,350,011 A | | 9/1994 | Sylvester |
| 5,785,361 A | | 7/1998 | Bourbour et al. |

FOREIGN PATENT DOCUMENTS

| | | |
|---|---|---|
| CA | 2341279 A1 | 9/2001 |

* cited by examiner

*Primary Examiner*—Jiping Lu
(74) *Attorney, Agent, or Firm*—Kathryn W. Grant; Eric Marich

(57) ABSTRACT

An apparatus for supplying relatively cool feedwater to a heated pressure vessel, while moderating the thermal gradients within the apparatus and the pressure vessel. The feedwater apparatus is generally comprised of a feedwater inlet nozzle, thermal sleeve and sparger assembly which is structured to provide a thermal barrier and to lengthen the path of heat conduction through the feedwater inlet nozzle; to insure adequate support for the thermal sleeve and the sparger; to improve feedwater flow through the thermal sleeve and the sparger; and to facilitate the inspection and repair of the welds used to structure the feedwater apparatus.

20 Claims, 2 Drawing Sheets

FEEDWATER APPARATUS

FIELD AND BACKGROUND OF INVENTION

The present invention relates, in general, to steam generator pressure vessels and, in particular, to an apparatus for supplying relatively cool feedwater to a heated pressure vessel while moderating the thermal gradients therein and in the vessel.

The present invention is particularly suitable for the type of steam generators that are associated with nuclear power plants. In this regard, such steam generators may be viewed as comprising a vertically oriented and substantially closed vessel within which a primary fluid which has been heated by circulation through the reactor core and a vaporizable fluid, in the form of feedwater, are made to flow in indirect heat exchange relationship, such that heat is transferred from the heated fluid to the feedwater. Moreover, in accordance with conventional practice, the steam generator vessel contains a bundle of heat exchange tubes with the ends of each of the heat exchange tubes being suitably retained within a pair of tube sheets. The steam generator vessel is generally substantially cylindrical in configuration, and has a tube sheet suitably mounted therewithin, such as to be positioned adjacent but spaced from each of the ends of the steam generator vessel. Each of the heat exchange tubes in the bundle is in turn suitably supported from the steam generator vessel so as to extend longitudinally therewithin, with the respective ends thereof emplaced in a corresponding one of the aforesaid pair of tube sheets. A cylindrical baffle or shroud is disposed about the bundle of heat exchange tubes to divide the steam generator vessel interior into an annular down flow passageway and an axially disposed evaporator chamber containing the bundle of heat exchange tubes. A plurality of feedwater inlet nozzles communicates with the annular down flow passageway. The feedwater inlet nozzles are generally formed as an integral part of the steam generator vessel, and are spaced at a common elevation around the steam generator vessel.

The heated primary fluid enters the steam generator vessel through a primary fluid inlet and is made to flow through the heat exchange tubes of the bundle, and thence discharged out of the steam generator vessel through a primary fluid outlet, to be conveyed through the remainder of the reactor coolant system. The feedwater is introduced through the feedwater inlet nozzles, and is made to flow down the annular passageway until the tube sheet near the bottom of the annular passageway causes the feedwater to reverse direction, passing in heat transfer relationship with the outside of the heat exchange tubes while flowing upwardly through the inside of the shroud. While the feedwater is circulating in heat transfer relationship with the heat exchange tubes of the bundle, heat is transferred from the heated primary fluid in the tubes to the feedwater surrounding the tubes causing a portion of the feedwater to be converted to steam. The steam then rises and is discharged from the steam generator vessel through one or more steam outlets for circulation through typical generating equipment to produce electricity in a manner well known in the art.

The feedwater inlet nozzle is fed by a supply conduit which is connected thereto for discharge into a thermal sleeve that extends within and through the feedwater inlet nozzle and has one end generally formed with or connected to a sparger, the latter distributes the feedwater downwardly through the annular passageway. The thermal sleeve acts as a shield to reduce the temperature gradients between the relatively cool feedwater flowing therethrough, as compared to the heated feedwater inlet nozzle and steam generator vessel.

The relatively large temperature gradients extending through the feedwater inlet nozzle from the warm steam generator vessel to the relatively cool feedwater tend to produce thermal stresses. Thermal gradients, and the thermal stresses resulting therefrom, are particularly aggravated as a result of changes in the feedwater flow through the inlet nozzle of this type steam generator, under certain operating conditions such as during the reactor start-up as well as during changes in the reactor power output. It is during these changes in feedwater flow that there occurs thermal cycling of the feedwater inlet nozzle and the thermal sleeve. Such thermal cycling may induce fatigue failure in the dissimilar metal weld which fixedly secures the thermal sleeve, through a transition ring, to the feedwater inlet nozzle. In fact, due to restricted access to this thermal sleeve weld region, it is difficult to detect and eliminate weld flaws. Moreover, since the nozzle is usually made of low alloy steel, it corrodes much faster than the thermal sleeve which is made of corrosion-resistant material. Thus, the feedwater inlet nozzle side of this dissimilar metal weld will be severely thinned. Obviously, this corrosion problem could be eliminated if the feedwater inlet nozzle were made of the same expensive corrosion-resistant material as that of the thermal sleeve. However, the material cost of such a modification would be high because of the heavy section size of the feedwater inlet nozzle. When the cantilever thermal sleeve and sparger unit is subjected to a bending moment by feedwater injection and pressure difference or the occurrence of an earthquake, significant bending and axial stresses will occur at the thinned cross section on the feedwater inlet nozzle side of the dissimilar metal weld. As a result, the thermal sleeve may develop fatigue cracks, and the ensuing leaks of feedwater may flow around the outer surface of the thermal sleeve, and come in direct contact with the feedwater inlet nozzle and hence cause undesirable cooling which may lead to thermal stresses in the area of the feedwater inlet nozzle and the surrounding wall portion of the steam generator vessel. The thermal stresses imposed on the feedwater inlet nozzle and the surrounding wall portion of the steam generator vessel will reduce the life expectancy of this equipment, if the undesirable cooling is not eliminated. Therefore, repair of the thermal sleeve is required whenever such leaks occur. However, the repair of the thermal sleeve has proven to be a difficult task, because of the restricted access to the dissimilar metal weld which is used to secure the thermal sleeve to the feedwater inlet nozzle.

Accordingly, this prior art feedwater inlet nozzle, thermal sleeve and sparger assembly has encountered limitations as to, the operating conditions of the feedwater system with respect to reactor start-ups and changes in reactor power output, and also with respect to feedwater flow-induced vibration and fretting of the thermal sleeve, and further with respect to the repair of the thermal sleeve. Thus, there is a need to provide industry with solutions to these problems.

SUMMARY OF INVENTION

These difficulties are overcome, to a large extent, through the practice of the present invention which provides an improved apparatus for supplying feedwater to a nuclear type steam generator pressure vessel. The apparatus is generally comprised of a feedwater inlet nozzle, a thermal sleeve and a sparger, and is structured to supply relatively cool feedwater as compared to its heated self and the heated pressure vessel, while moderating the thermal gradients across the feedwater inlet nozzle and the surrounding wall portion of the pressure vessel; reducing the feedwater flow-induced vibration and fretting of the thermal sleeve; improving the structural support of the thermal sleeve and sparger; and facilitating the repair of the thermal sleeve.

Accordingly, there is provided a feedwater source including a conduit to supply the feedwater to the thermal sleeve which extends through the bore of the feedwater inlet nozzle and through an inlet in the steam pressure vessel wall. The thermal sleeve, which is fixedly supported by the feedwater nozzle, conveys the feedwater to the sparger located in the steam pressure vessel. The underside of the sparger includes a plurality spray holes which inject the feedwater downward into an annular passageway formed between the pressure vessel wall and a shroud that defines the evaporator chamber. The downstream end of the sparger is closed off by a generally flat plate which acts to deflect the feedwater toward the spray holes. The deflector plate can either be formed as an integral part of the sparger or be welded thereto. The deflector plate is advantageously sloped at an angle of 45 degrees measured clockwise from the longitudinal axis of the sparger so as to smoothen the flow of feedwater through the thermal sleeve and the sparger, thereby lengthening the life expectancy of the apparatus by reducing the flow-induced vibration and fretting.

The feedwater nozzle has its inlet face welded to the discharge end of the feedwater supply conduit, and also to the thermal sleeve as one of the two points used to support the sleeve. The other of the two points used to support the thermal sleeve is a weld between the outlet end of the feedwater nozzle and the thermal sleeve. This two-point support arrangement acts to increase the mechanical strength of the feedwater apparatus and, particularly, that of the thermal sleeve and sparger assembly, with a concomitant reduction in stress corrosion. The welds providing the two-point support for the thermal sleeve and sparger assembly are dissimilar welds to accommodate cost restraints requiring that the feedwater nozzle be made out of a metal composition that is less resistant to corrosion than that used in the making of the thermal sleeve. As a result, the feedwater nozzle side of the dissimilar weld will eventually become severely thinned and require repair. The feedwater apparatus is advantageously structured in that all of the welds, including the two dissimilar welds used to fixedly attach the thermal sleeve to the feedwater nozzle are readily accessible for inspection and repair.

The feedwater inlet nozzle has a cylindrically-shaped inner surface which defines a bore extending therethrough. The feedwater nozzle has an inlet and an outlet end portion wherein the bore is sized to obtain a tight fit or, alternatively, an interference fit between the inner surface of these nozzle portions and the outer surface of the correspondingly adjacent portions of the thermal sleeve. The feedwater nozzle inner surface which lies intermediate of the tight-fitting nozzle end portions is configured to form a recess therein and to cooperate with the recessed walls and the outer surface of the thermal sleeve to define an annular chamber therebetween. The chamber is provided with one or more threaded passageway openings extending through the body of the feedwater nozzle. A threaded plug is also provided to shut off the passageway opening. The chamber extends over a major length of the feedwater nozzle bore and is filled with a dry gaseous medium, for example, dry nitrogen or dry air, thereby forming a thermal barrier between the relatively cool feedwater flowing through the thermal sleeve and the heated surrounding portions of the feedwater nozzle and pressure vessel wall, and thus moderating the thermal gradients and the thermal stresses resulting therefrom. The use of dry nitrogen gas is preferred since it reduces stress erosion in the chamber.

A collar is coaxially disposed around the feedwater inlet nozzle intermediate the inlet and outlet portions thereof. The collar is normally formed as an integral part of the feedwater nozzle, and has a downstream end portion welded to the pressure vessel wall and an upstream end portion abutting a flanged ring which is provided with a plurality of circumferentially spaced apertures. The pressure vessel wall includes a plurality of apertures circumferentially spaced around the vessel wall inlet and penetrating the wall. These apertures correspond in number and arrangement to the apertures provided in the flanged ring. Fastening means that are generally in the form of threaded studs and lock nuts are used to clamp the flanged ring against the collar so as to forcibly and further secure the feedwater inlet nozzle to the pressure vessel wall. The collar includes an annular portion which is located intermediate of the downstream and upstream end portions of the collar. The annular portion of the collar is advantageously configured with a plurality of circumferentially spaced grooves that serve to lengthen the path of heat conduction, and thereby reduce the thermal gradients and the thermal stresses resulting therefrom. The land segments formed between the grooves provide the force transfer path used to rigidly secure feedwater inlet nozzle to the pressure vessel wall.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

The present invention will be better understood and its advantages will be more appreciated from the detailed description of the preferred embodiment, especially when read with reference to the accompanying drawings, wherein.

DESCRIPTION OF THE PREFERRED EMBODIMENTS

Figure 1:
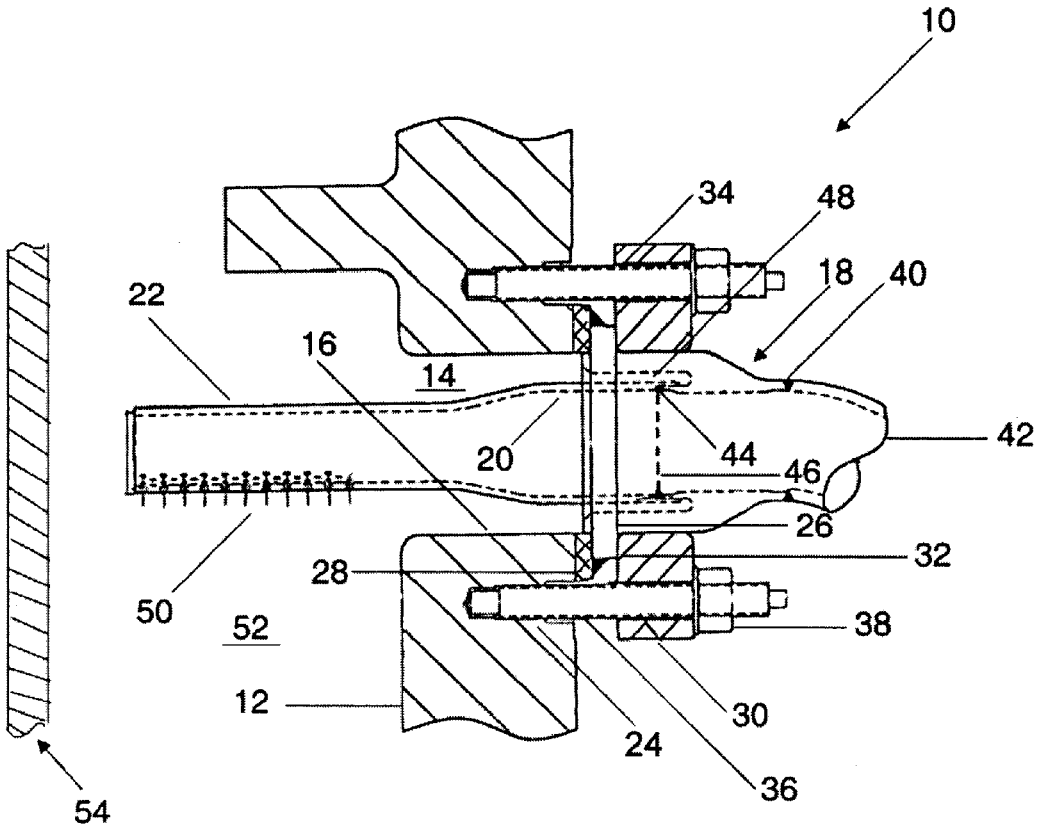
FIG. 1 PRIOR ART
FIG. 1 is a schematic sectional side view of a feedwater apparatus comprised of a feedwater inlet y-forging nozzle, thermal sleeve and sparger assembly known in the art.

Referring to FIG.1 of the drawings, there is shown a prior art feedwater apparatus 10, with the partial cross section of the wall 12 of a vertically extending, substantially cylindrically-shaped steam generator pressure vessel. The feedwater apparatus 10 extends within and through the bore 14 of an inlet 16 formed through the wall 12 of the pressure vessel, and is generally comprised of a feedwater inlet nozzle 18, a thermal sleeve 20 and a sparger 22. The pressure vessel wall 12 is provided with a plurality of apertures 24 circumferentially spaced around the inlet 16 and penetrating the outside of the vessel wall 12. The outlet end of the feedwater inlet nozzle 18 is located adjacent to the vessel wall inlet 16, and includes a collar 26 which is welded to a retaining ring 28 abutting the steam generator vessel wall 12. A flanged ring 30 rests on the shoulder 32 configured by the collar 26 and is axially aligned with the bore 14 of the vessel wall inlet 16. The flanged ring 30 is provided with a plurality of apertures 34 which correspond in number and arrangement to the apertures 24 which penetrate the steam generator vessel wall 12. Fastening means, which are generally in the form of threaded studs 36 and lock nuts 38, are provided to clamp the flanged ring 30 against the collar 26, thereby forcibly securing the feedwater inlet nozzle 18 to the steam generator wall 12. A weld 40 connects the inlet end of the feedwater nozzle 18 to a feedwater supply conduit 42.

The thermal sleeve 20 has its downstream end formed as an integral part of or, alternatively, welded to the sparger 22, and its upstream end connected by a dissimilar metal weld 44 to a transition ring, not shown, with the latter, in turn, being welded to the feedwater inlet nozzle 18. The outer surface of the inlet end portion of the thermal sleeve 20 is narrowly spaced from the inner surface of the feedwater inlet nozzle 18 to define therebetween a constricted annular passage 48 opening into the bore 14 of the steam generator vessel wall inlet 16. Water will fill the annular passage 48 during operation.

The sparger 22 includes a plurality of spray holes 50 that direct the relatively cool feedwater downward through an annular passageway 52 formed between the heated steam generator vessel wall 12 and a heated shroud 54 that defines a conventional evaporator chamber, not shown.

Although the steam generator vessel is generally protected from the thermal stresses caused by temperature differences, the feedwater inlet nozzle 18 and the surrounding or nearby portion of the vessel wall 12 and, more particularly, the weld juncture 46 between the thermal sleeve 20 and the feedwater inlet nozzle 18 continue to be limiting factors for this prior art feedwater apparatus. In fact, and as shown in FIG. 1, because of the narrowness of the constricted passage 48, there is limited access to the dissimilar weld 44 which connects the thermal sleeve 20 through a transition ring, not shown, to the feedwater inlet nozzle 18, thus, making it difficult to detect and eliminate flaws in the dissimilar weld 44. Also, the weld 44 will be severely thinned, since the transition ring of the feedwater inlet nozzle 18 is usually made of low alloy steel and corrodes much faster than the thermal sleeve 20, which is typically made of corrosion-resistant material. Therefore, when the cantilever thermal sleeve 20 and sparger 22 components of the feedwater apparatus 10 are subjected to a bending moment created by feedwater injection and pressure differences or by an earthquake, significant bending and axial stresses on the thinned cross section may occur at the location of the dissimilar metal weld 44. As a result, the thermal sleeve 20 may develop fatigue cracks and the ensuing leaks of feedwater may flow around the outer surface of the thermal sleeve 20, and come in direct contact with the feedwater inlet nozzle 18. This, in turn, can lead to significant thermal stresses in the feedwater inlet nozzle 18 and the adjacent wall 12 portion of the steam generator pressure vessel. Repair of the thermal sleeve 20 is required whenever such leakage of feedwater occurs, since the significant thermal stresses imposed on the relatively hot feedwater inlet nozzle 18 and the surrounding wall portion of the steam generator by the leakage of the relatively cool feedwater being supplied by the conduit 42 will reduce the life expectancy of the equipment.

Figure 2:
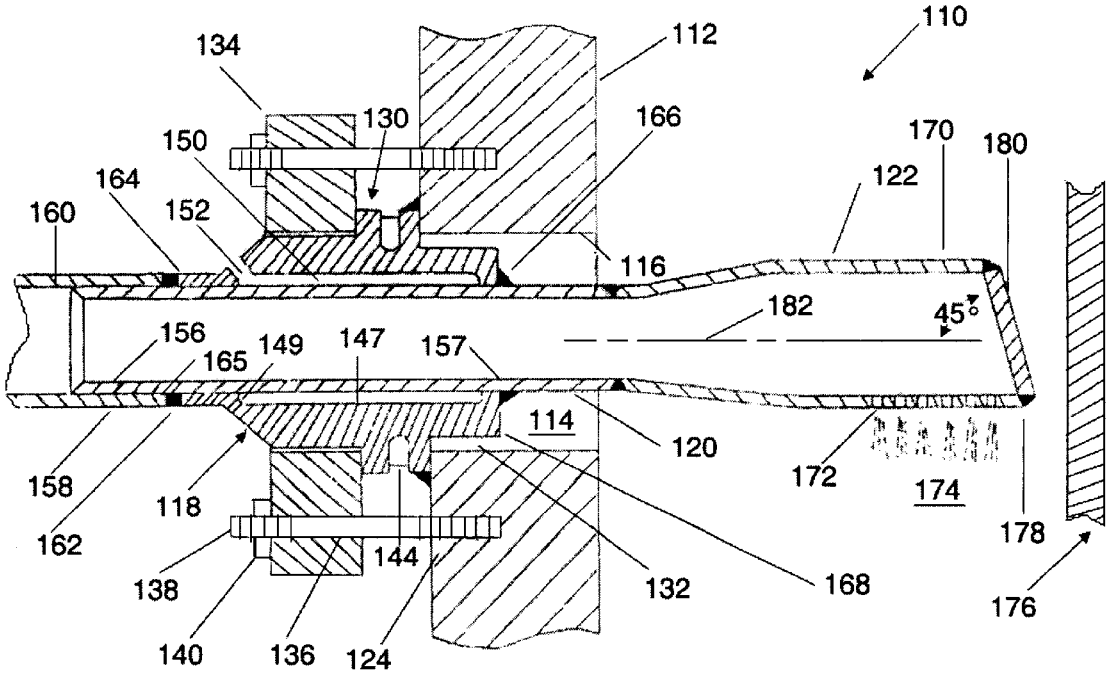
FIG. 2 is a schematic sectional side view of a feedwater apparatus comprised of a feedwater inlet nozzle, thermal sleeve and sparger assembly which incorporates the present invention.
Figure 3:
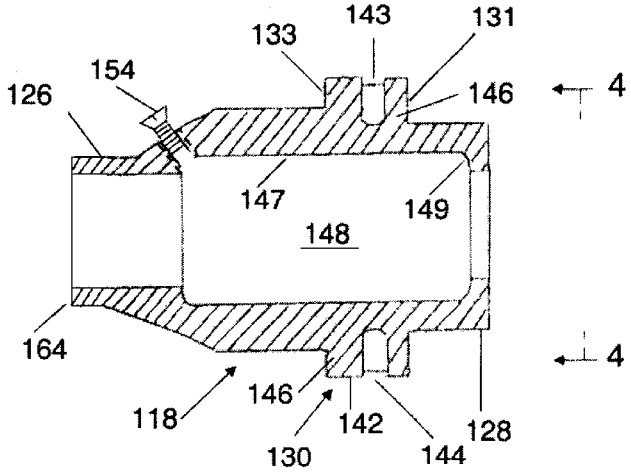
FIG. 3 is a schematic sectional side view of the feedwater inlet nozzle shown in FIG. 2.
Figure 4:
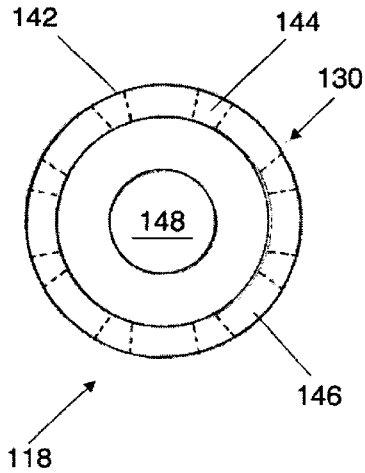
FIG. 4 is an end view of the feedwater inlet nozzle taken along line 4—4 of FIG. 3.

Turning now to the preferred embodiment of the present invention as depicted in FIGS. 2, 3, and 4, wherein like reference numerals are used to refer to the same or functionally similar elements.

In FIG. 2 there is shown a feedwater apparatus 110 incorporating the present invention, and a partial cross section of the wall 112 of a vertically extending, substantially cylindrically-shaped steam generator pressure vessel. The feedwater apparatus 110 extends within and through the cylindrically-shaped bore 114 of an inlet 116 formed through the wall 112 of the pressure vessel. The feedwater apparatus 110 is generally comprised of a feedwater inlet nozzle 118, a thermal sleeve 120 and a sparger 122. The steam generator vessel wall 112 includes a plurality of apertures 124 circumferentially spaced around the inlet 116 and penetrating the outside of the vessel wall 112. The feedwater inlet nozzle 118, also shown at FIGS. 3 and 4, has an inlet portion 126 and an outlet portion 128. A collar 130 is located between the inlet portion 126 and the outlet portion 128 of the feedwater nozzle 118, and is normally formed as an integral part of the nozzle 118. The outlet portion 128 of the nozzle 118 lies within the bore 114 and its outer surface is spaced from the inner surface of the pressure vessel inlet 116, to define therebetween a constricted or narrow annular cavity 132 opening into the remainder of the bore 114. The downstream end portion 131 of the collar 130 is welded to the steam generator vessel wall 112, and the upstream end portion 133 of the collar 130 abuts a flanged ring 134, which is provided with a plurality of apertures 136 that correspond in number and arrangement to the apertures 124 which penetrate the steam generator vessel wall 112. Fastening means, which are generally in the form of threaded studs 138 and lock nuts 140, are provided to clamp the flanged ring 134 against the collar 130, thereby forcibly and rigidly securing the feedwater inlet nozzle 118 to the steam generator vessel wall 112.

In accordance with the present invention, the rim 142 of the collar 130 includes an annular portion 143 situated between the downstream and upstream end portions 131 and 133 of the collar 130, and configured with a plurality of circumferentially spaced grooves 144 which serve to lengthen the path for heat conduction thereby reducing the thermal gradients and the thermal stresses resulting therefrom. The land segments 146 located between the grooves 144 provide the force transfer path between the flanged ring 134 and the pressure vessel wall 112. The threaded studs 138 pass through the corresponding apertures 124 and 136 and cooperate with the lock nuts 140 to forcibly and rigidly secure the feedwater inlet nozzle 118 to the vessel wall 112.

The inner surface of the feedwater inlet nozzle 118 defines a cylindrically-shaped bore 148. The portions of the bore 148 which lie within the nozzle inlet portion 126 and the nozzle outlet portion 128 are sized to obtain a tight or, alternatively, an interference fit between the inner surface of the nozzle inlet portion 126 and the outer surface of the thermal sleeve inlet. portion 156, and between the inner surface of the nozzle outlet portion 128 and the outer surface of the thermal sleeve outlet portion 157.

The nozzle inner surface, which lies intermediate of the respective inner surfaces of the tight or interference fitting nozzle portions 126 and 128, is configured to form a recess 147 therein and-to cooperate with the recessed walls 149 and the outer surface of the thermal sleeve 120 to define an enclosed annular chamber 150 therebetween. The chamber 150 is provided with a passageway opening 152 extending through the body of the feedwater inlet nozzle 118. The opening 152 is preferably threaded to accommodate the closing thereof with a threaded plug 154, as shown at FIG. 3.

In accordance with the present invention, a dry gaseous medium, for example, dry nitrogen or dry air is introduced through the passageway opening 152 into the comparatively lengthy chamber 150 which, when filled, is closed off with the plug 154. Dry nitrogen gas is the preferred medium for filling the chamber 150 since it can reduce erosion. The annular chamber 150 covers a major lengthwise portion of the feedwater nozzle 118 and the dry gaseous medium, which fills the annular chamber 150, forms a thermal barrier between the relatively cool feedwater flowing through the thermal sleeve 120 and the surrounding portions of the heated feedwater inlet nozzle 118 and pressure vessel wall 112, and thus acts to moderate the thermal gradients and the thermal stresses resulting therefrom.

The inlet portion 156 of the thermal sleeve 120 extends from within the outlet end portion 158 of the feedwater supply conduit 160 through the bore 148 of the feedwater inlet nozzle 118 and through the pressure vessel wall inlet 116. The outlet end of the thermal sleeve 120 is welded to the inlet end of the sparger 122. Alternatively, the sparger 122 may be formed as an integral part of the thermal sleeve 120. The outer surface of the thermal sleeve 120 is in tight or, alternatively, interference fit engagement with the inner surface of outlet end portion 158 of the feedwater supply conduit 160.

In accordance with the present invention, the thermal sleeve 120 extends within the outlet portion 158 of the feedwater supply conduit 160 and the inlet portion 126 of the feedwater inlet nozzle 118 in tight or interference fit engagement and is fixedly connected by a first dissimilar weld 162 to the inlet end 164 of the feedwater inlet nozzle 118 and the outlet end 165 of the feedwater supply conduit 158, and is further fixedly connected by a second dissimilar weld 166 to the outlet end 168 of the feedwater inlet nozzle 118. The welds 162 and 166 are referred to as dissimilar welds since they are used to join components of different metal composition as in the case of the nozzle 118 and the thermal sleeve 120. The two-point support provided by the tight engagement and the dissimilar welds 162 and 166 for the thermal sleeve 120 and sparger 122 assembly acts to increase the mechanical strength of the feedwater apparatus 110 and, particularly, that of the thermal sleeve 120 and sparger 122 assembly, with a concomitant reduction in stress corrosion.

Moreover, the present invention provides full access to the welds used to structure the feedwater apparatus 110, thereby facilitating the inspection and repair of such welds. Furthermore, the construct of the feedwater apparatus 110 allows for the thermal sleeve second dissimilar weld 166 to be placed within the bore 114 of the inlet 116 of the steam generator vessel wall 112, rather than having to locate this weld in the constricted annular cavity 132, as in the case of the prior art feedwater apparatus 10, shown in FIG. 1, where the dissimilar weld 44 had to be placed in the constricted passage 50. As a result of providing full access to all of its welds, the construct of the present invention assures the integrity of such welds.

The underside of the outlet end portion 170 of the sparger 122 includes a plurality of spray holes 172 which produce the desired spray pattern, while directing the relatively cool feedwater downward through an annular passageway 174 formed between the steam generator vessel wall 112 and a shroud 176 that defines a conventional evaporator chamber, not shown. The direction of the downward sprayed feedwater is generally away from the vessel wall 112 so as to avoid local temperature variations, and thereby prevent thermal cycling of the steam generator vessel wall 112.

In accordance with the present invention, the downstream end 178 of the sparger 122 is advantageously formed with a downward sloped deflector plate 180 which acts to direct the feedwater toward the spray holes 172. The defector plate 180 can be welded to the downstream end 178 of the sparger 122, as shown in FIG. 2, or it can be formed as an integral part of the sparger 122. The deflector plate 180 extends at an angle of 45 degrees measured clockwise from the longitudinal axis 182 of the sparger 122. The 45 degree slope of the deflector plate 180 acts to smoothen the feedwater flow and, thus, reduces the flow-induced vibration and fretting.

Although the present invention has been described above with reference to particular means, materials and embodiments, it is to be understood that this invention may be varied in many ways without departing from the spirit and scope thereof, and therefore is not limited to these disclosed particulars but extends instead to all equivalents within the scope of the following claims.

I claim:

1. In combination with a heated pressure vessel, an apparatus for supplying feedwater to the vessel, the feedwater being relatively cool as compared to the heated vessel, the vessel having at least one wall opening, a feedwater source, the feedwater source having at least one conduit, the apparatus being structured to moderate thermal gradients therein and in the vessel, and comprising:

an inlet nozzle having an inlet end and an outlet end, and the inlet end being connected to the conduit;

a cylindrically-shaped inner surface spanning the nozzle, the inner surface defining a bore;

a thermal sleeve having an inlet portion and an outlet portion, the sleeve extending through the nozzle bore;

a first weld fixedly connecting the sleeve inlet portion to the inlet end of the nozzle;

a second weld fixedly connecting the sleeve outlet portion to the outlet end of the nozzle;

a sparger disposed within the vessel and communicating with the sleeve outlet portion, the sparger having at least one outlet port to spray the feedwater into the vessel; and whereby the first and second welds provide a rigid two-point support for said thermal sleeve and sparger.

2. The combination according to claim 1 including an outlet portion of the nozzle being disposed within the vessel wall opening and cooperating with the vessel wall to form a constricted cavity therebetween, and wherein the second weld is located downstream of the constricted cavity.

3. The combination according to claim 1 including a collar coaxially disposed around the nozzle.

4. The combination according to claim 3 wherein the collar is formed as an integral part of the nozzle, the collar having an upstream end portion and a downstream end portion, the upstream end portion abutting a flanged ring, the downstream end portion abutting the vessel wall, and fastening means for rigidly securing the flanged ring and the collar to the vessel wall.

5. The combination according to claim 3 wherein the collar rim is formed with at least one groove.

6. The combination according to claim 3 wherein the collar rim is formed with a plurality of grooves circumferentially-equidistant from one another.

7. The combination according to claim 6 wherein the collar rim includes an annular portion disposed intermediate of the collar upstream and downstream end portions, and the grooves being formed in the annular portion.

8. The combination according to claim 6 including land segments formed between the grooves.

9. The combination according to claim 1 wherein an intermediate portion of the inner surface of the nozzle is configured to form a recess therein and to cooperate with the recessed walls and the outer surface of the sleeve to define an enclosed chamber therebetween.

10. The combination according to claim 9 wherein the chamber is filled with a gaseous medium.

11. The combination according to claim 10 wherein the gaseous medium is dry nitrogen gas.

12. The combination according to claim 10 wherein the gaseous medium is dry air.

13. The combination according to claim 9 wherein the chamber includes at least one opening.

14. The combination according to claim 13 wherein the opening includes a passageway formed through the nozzle.

15. The combination according to claim 13 including a plug to shut off the opening.

16. The combination according to claim 1 wherein the sparger includes a deflector plate disposed downstream of the outlet port.

17. The combination according to claim 16 wherein the deflector plate is connected to the sparger.

18. The combination according to claim 16 wherein the deflector plate is formed as an integral part of the sparger.

19. The combination according to claim 16 wherein the deflector plate is sloped in a downward direction away from the vessel wall.

20. The combination according to claim 16 wherein the deflector plate is sloped at an angle of 45 degrees measured clockwise from the longitudinal axis of the sparger.

* * * * *